US009719229B2

(12) United States Patent
Bandou et al.

(10) Patent No.: US 9,719,229 B2
(45) Date of Patent: Aug. 1, 2017

(54) BUCKET AND WORKING VEHICLE PROVIDED WITH THE SAME

(71) Applicant: KOMATSU LTD., Minato-ku, Tokyo (JP)

(72) Inventors: Norihito Bandou, Oyama (JP); Takeshi Saoyama, Hitachinaka (JP); Minoru Wada, Hitachinaka (JP); Toshiyuki Ohta, Hitachinaka (JP); Toshimitsu Honda, Hitachinaka (JP); Katsuhiro Tsutsumi, Hitachinaka (JP); Takaya Kobayashi, Hitachinaka (JP); Takayasu Wakamoto, Komatsu (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 0 days.

(21) Appl. No.: 14/894,126

(22) PCT Filed: Jul. 15, 2015

(86) PCT No.: PCT/JP2015/070325
§ 371 (c)(1),
(2) Date: Nov. 25, 2015

(87) PCT Pub. No.: WO2015/167026
PCT Pub. Date: Nov. 5, 2015

(65) Prior Publication Data

US 2017/0016204 A1 Jan. 19, 2017

(51) Int. Cl.
*E02F 3/40* (2006.01)
*E02F 3/34* (2006.01)

(52) U.S. Cl.
CPC . *E02F 3/40* (2013.01); *E02F 3/34* (2013.01)

(58) Field of Classification Search
CPC ..... E02F 3/40
(Continued)

(56) References Cited

U.S. PATENT DOCUMENTS 3,109,248 A * 11/1963 Vos ..... E02F 3/40 37/408
3,659,730 A * 5/1972 Butler ..... E02F 3/407 37/444

(Continued)

FOREIGN PATENT DOCUMENTS

GB 2362371 11/2001
JP H07-179153 7/1995

(Continued)

OTHER PUBLICATIONS

Office Action in corresponding Japanese Patent Application No. 2015-552915, issued Mar. 8, 2016, including English Translation, 8 pages.

(Continued)

*Primary Examiner* — Gary Hartmann
(74) *Attorney, Agent, or Firm* — Fish & Richardson P.C.

(57) ABSTRACT

A bucket with a blade-shaped lower front edge includes: a first straight portion horizontally extending from the lower front edge toward an innermost of the bucket; a curve continuous with a rear edge of the first straight portion at a lower edge of the curve, the curve having a predetermined bucket radius; a second straight portion continuous with an upper edge of the curve, the second straight portion being inclined upward toward a bucket opening; a third straight portion bent at a bent portion toward the bucket opening relative to a front edge of the second straight portion, the third straight portion further extending toward the bucket opening; a reinforcing member provided on an exterior surface of the third straight portion to reinforce of the exterior surface; and a connecting portion provided behind the curve.

5 Claims, 4 Drawing Sheets

(58) Field of Classification Search
USPC ..... 37/444
See application file for complete search history.

(56) References Cited

U.S. PATENT DOCUMENTS

| | | | | |
|---|---|---|---|---|
| 4,081,919 | A * | 4/1978 | Teach | E02F 3/40 37/444 |
| 4,086,712 | A * | 5/1978 | McReynolds | E02F 3/8152 37/444 |
| 8,015,734 | B1 | 9/2011 | Mills et al. | |
| 8,201,350 | B2 * | 6/2012 | Folkerts | E02F 9/2825 37/379 |
| 9,139,975 | B2 * | 9/2015 | Rochel | E02F 3/40 |
| 9,163,377 | B2 * | 10/2015 | France | E02F 3/40 |
| 9,366,006 | B2 * | 6/2016 | Morinaga | E02F 3/40 |
| 9,447,561 | B2 * | 9/2016 | Nitti | E02F 3/40 |
| 2007/0131466 | A1 | 6/2007 | Gutzwiller et al. | |
| 2009/0003984 | A1 | 1/2009 | Osanai et al. | |
| 2010/0037493 | A1 * | 2/2010 | Kim | B22C 5/00 37/444 |
| 2011/0289803 | A1 | 12/2011 | Folkerts et al. | |
| 2012/0301258 | A1 | 11/2012 | Nagata et al. | |
| 2013/0067779 | A1 | 3/2013 | Mills et al. | |
| 2015/0032644 | A1 * | 1/2015 | Zeno | E02F 3/40 705/307 |

FOREIGN PATENT DOCUMENTS

| | | |
|---|---|---|
| JP | H11-286956 | 10/1999 |
| JP | 2007-186929 A | 7/2007 |
| JP | H04-117046 U | 7/2008 |
| JP | 2013-526664 A | 6/2013 |
| WO | WO 2007/058545 | 5/2007 |
| WO | WO 2011-049061 A1 | 4/2011 |

OTHER PUBLICATIONS

International Search Report dated Aug. 18, 2015 from corresponding International Application No. PCT/JP2015/070325, including English translation, 4 pages.

Kuniaki Nakada et al., Komatsu Technical Report, vol. 51, No. 156, Komatsu Ltd., "Research and Development of Low-noise Bucket for Construction Machinery", Feb. 28, 2006.

Extended European Search Report in European Application No. 15785840.8, dated Feb. 1, 2017, 6 pages.

* cited by examiner

BUCKET AND WORKING VEHICLE PROVIDED WITH THE SAME

CROSS-REFERENCE TO RELATED APPLICATIONS

This application claims priority to International Application No. PCT/JP2015/070325 filed on Jul. 15, 2015, the contents of which are incorporated herein by reference in their entirety.

TECHNICAL FIELD

The present invention relates to a bucket and a working vehicle provided with the same.

BACKGROUND ART

A typical working vehicle such as a wheel loader is provided with working equipment including a bucket. When seen in a cross sectional view, a known bucket includes: a middle portion curved in an arc with a predetermined bucket radius; a bottom linearly extending from a lower side of the middle portion in a tangent direction of the arc; and a top linearly extending from an upper side of the middle portion in the tangent direction of the arc (see, for instance, Patent Literature 1).

CITATION LIST

Patent Literature(s)

Patent Literature 1: JP-A-2013-526664

SUMMARY OF THE INVENTION

Problem(s) to be Solved by the Invention

Such a typical bucket, however, entails a problem in a shoveling work or an excavation work on a heap of earth, ground or the like depending on the type, size (diameter) or the like of an object. Specifically, an object pushed and remaining in the middle portion deep inside the bucket blocks the following object from entering the bucket, which results in prevention of a smooth shoveling work and thus in failure in increasing workload (productivity).

Accordingly, to solve the above problem, the bucket may have a larger bucket radius at the deep inside thereof in a cross sectional view to increase a deep-side bucket capacity.

However, such a simple increase in the bucket capacity leads to interference of the bucket with a portion therebehind (i.e., a boom adjacent to the bucket at a vehicle-rear side) when the wheel loader is in a traveling position. An increase in the capacity is thus limited. When the position of the bucket is shifted forward to prevent the interference, a reduction in a bucket depth is inevitable, and thus the capacity cannot be increased.

An object of the invention is to provide a bucket capable of reliably increasing workload, and a working vehicle provided with the bucket.

Means for Solving the Problem(s)

According to an aspect of the invention, a bucket with a blade-shaped lower front edge includes: a first straight portion horizontally extending from the lower front edge toward an innermost of the bucket; a curve continuous with a rear edge of the first straight portion at a lower edge of the curve, the curve having a predetermined bucket radius; a second straight portion continuous with an upper edge of the curve, the second straight portion being inclined upward toward a bucket opening; a third straight portion bent at a bent portion toward the bucket opening relative to a front edge of the second straight portion, the third straight portion further extending toward the bucket opening; a reinforcing member provided on an exterior surface of the third straight portion to reinforce of the exterior surface; and a support portion provided behind the curve and connected to an end of the boom.

In the above aspect, the curve has a large bucket radius as compared with that of a typical bucket. As the bucket with the large bucket radius is thrust forward for a shoveling work or an excavation work, an object, which has been pushed into the bucket to reach the curve through the first straight portion, can further slide to rise along the curve at the innermost of the bucket. The object can thus be pushed into the bucket more and more without being blocked.

Further, while the large bucket radius is not expected to increase the bucket capacity so much, the bulging portion defined by the second and third straight portions and the bent portion, i.e., the upper portion of the bucket, increases the bucket capacity. The bucket capacity can thus be ensured without the necessity of upwardly changing a dimension of the bucket opening, and the object can further smoothly enter the bucket through the upper portion of the bucket opening by the presence of the curve having the large bucket radius.

As described above, when the curve has the large bucket radius, and the bulging portion is provided to increase the bucket capacity, the object can be smoothly pushed toward the innermost of the bucket, which results in ensuring an increase in the bucket capacity and thus in a reliable increase in workload.

In the above aspect, it is preferable that the first straight portion includes a plate-shaped attachment portion defining the lower front edge and a plate-shaped bottom continuous with a rear edge of the plate-shaped attachment portion.

In the above aspect, it is preferable that the bent portion is close to the innermost of the bucket relative to the reinforcing member.

According to another aspect of the invention, a working vehicle includes the bucket.

In the above aspect, it is preferable that the working vehicle further includes: a vehicle body frame; and a boom that connects the bucket and the vehicle body frame, in which a distance between the bucket and the boom is minimized at the bent portion when the wheel loader is in a traveling position.

BRIEF DESCRIPTION OF DRAWING(S)

DESCRIPTION OF EMBODIMENT(S)

An exemplary embodiment of the invention will be described below with reference to the attached drawings.

Figure 1:
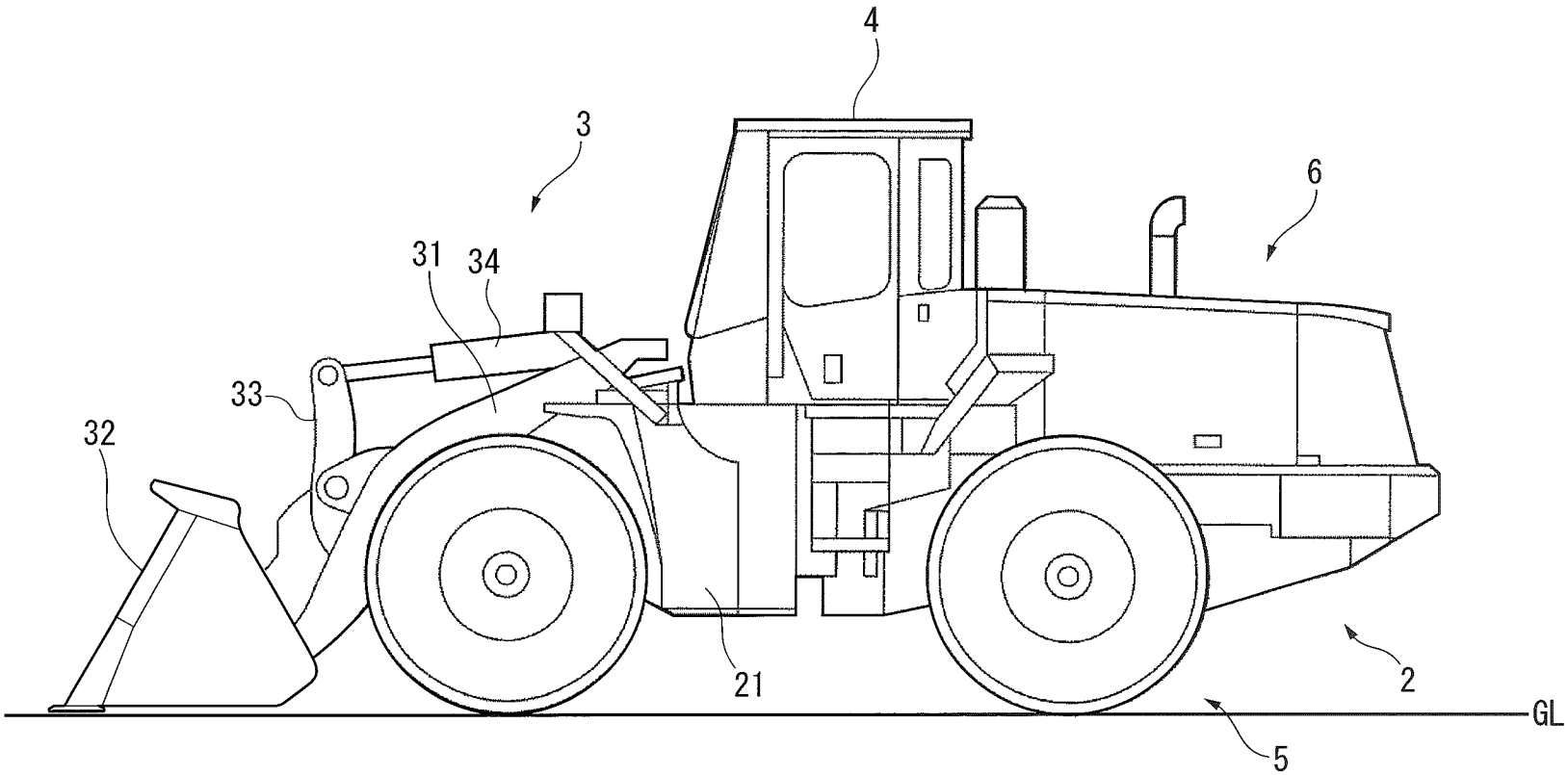
FIG. 1 is a side view showing a working vehicle according to an exemplary embodiment of the invention.

FIG. 1 is a side view showing a wheel loader 1 (working vehicle) according to the exemplary embodiment. It should be noted that, in the figures, directions are determined with reference to an operator in an operating state for the wheel loader 1. Specifically, a vehicle front-rear direction is simply referred to as a front-rear direction, a vehicle width direction is referred to as a right-left direction, and a vehicle up-down (vertical) direction is simply referred to as an up-down (vertical) direction. Further, an innermost of the bucket means a rear side relative to a bucket opening.

Description of Overall Arrangement of Wheel Loader

As shown in FIG. 1, the wheel loader 1 includes a steel vehicle body 2. The vehicle body 2 includes a rear vehicle body frame and a steel front vehicle body frame 21, which is a vehicle body frame swingable in the right-left direction relative to the rear vehicle body frame. The rear vehicle body frame is provided with a cab 4, a traveling unit 5 and a power output section 6. Working equipment 3 is supported at a front side of the front vehicle body frame 21.

The working equipment 3 is described in detail. The working equipment 3 includes a boom 31 pivotally supported by the front vehicle body frame 21, a bucket 32 vertically pivotally supported by the boom 31, and a bell crank 33 pivotally supported by the boom 31 at a middle of the boom 31.

The boom 31, which includes right and left pair of booms, is pivotally supported to be vertically swingable relative to the front vehicle body frame 21. A lift cylinder (not shown) is supported at the middle of the boom 31, the lift cylinder having a base end portion pivotally supported by the front vehicle body frame 21. A hydraulic extension and retraction of the lift cylinder causes the boom 31 to be vertically swung.

The bucket 32 is to be loaded with an object W (FIG. 3) such as excavated soil. The bucket 32 has a link (not shown) that is pivotally supported above a position where the bucket 32 is pivotally supported by the boom 31. The opposite end of the link is pivotally supported at a lower end of the bell crank 33.

The bell crank 33, which is pivotally supported between the pair of booms 31, has the lower end connected to a base end portion of the link. A bucket cylinder 34 is pivotally supported at an upper end of the bell crank 33. A base end portion of the bucket cylinder 34 is pivotally supported by the front vehicle body frame 21.

Figure 3:
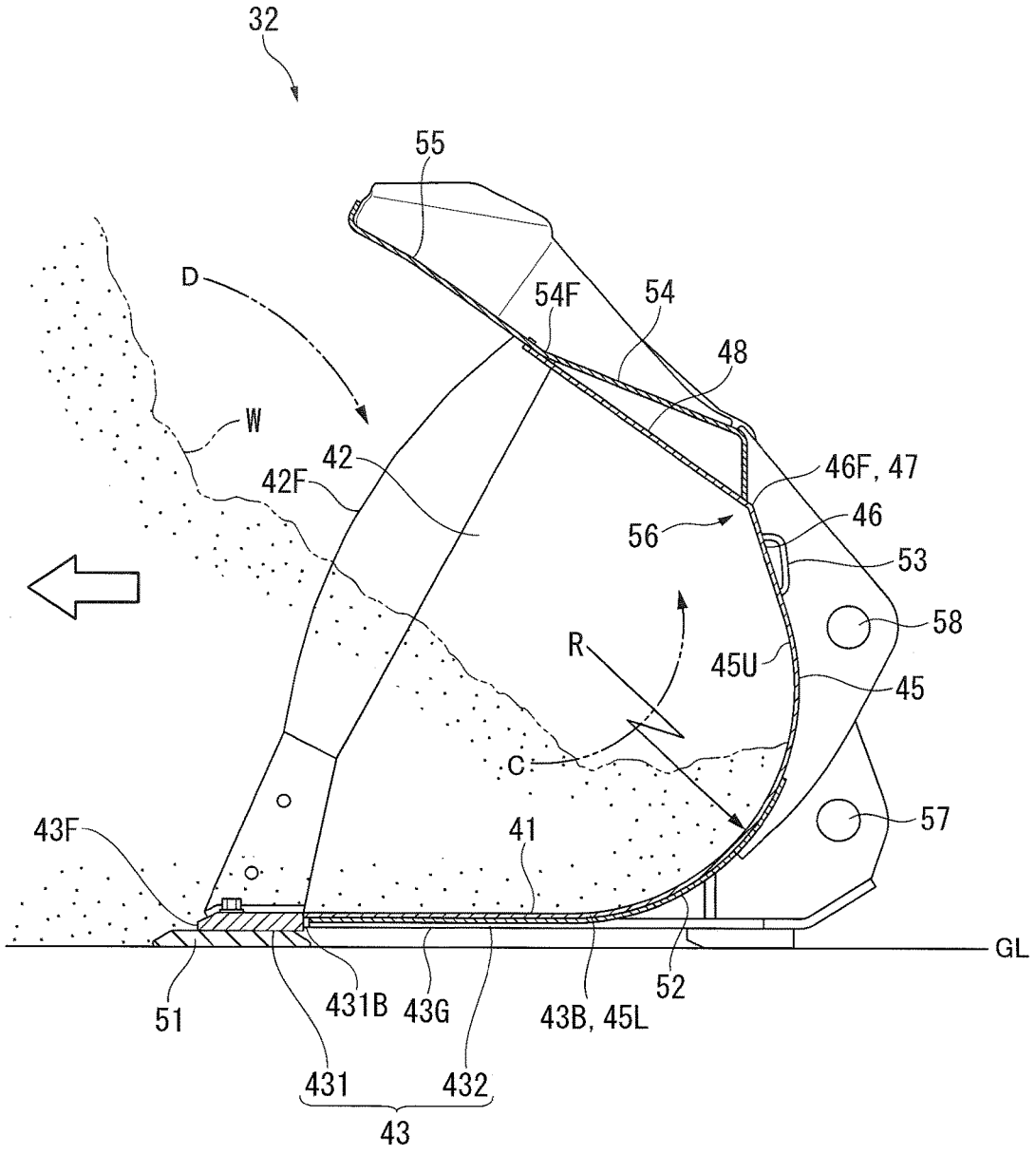
FIG. 3 is a cross sectional view showing the bucket.

The bucket 32 is positioned to be slightly in contact with a ground surface GL and thrust into a pile of crushed fine rocks and sand (a white arrow in FIG. 3 shows a thrusting direction). When the lift cylinder is extended, the boom 31 is swung upward with the bucket 32 being loaded with the object W (FIG. 3) to perform the shoveling work or the excavation work.

Further, when the bucket cylinder 34 is retracted with the bucket 32 being positioned above, an upper end portion of the bell crank 33 is rotated toward the vehicle body 2, while a lower end portion thereof is rotated toward a vehicle front side. The link then pushes an upper portion of the bucket 32 toward the vehicle front side, thereby rotating the bucket 32 to unload the object W in the bucket 32 onto a load bed of, for instance, a dump truck.

Specific Description of Bucket

Figure 2:
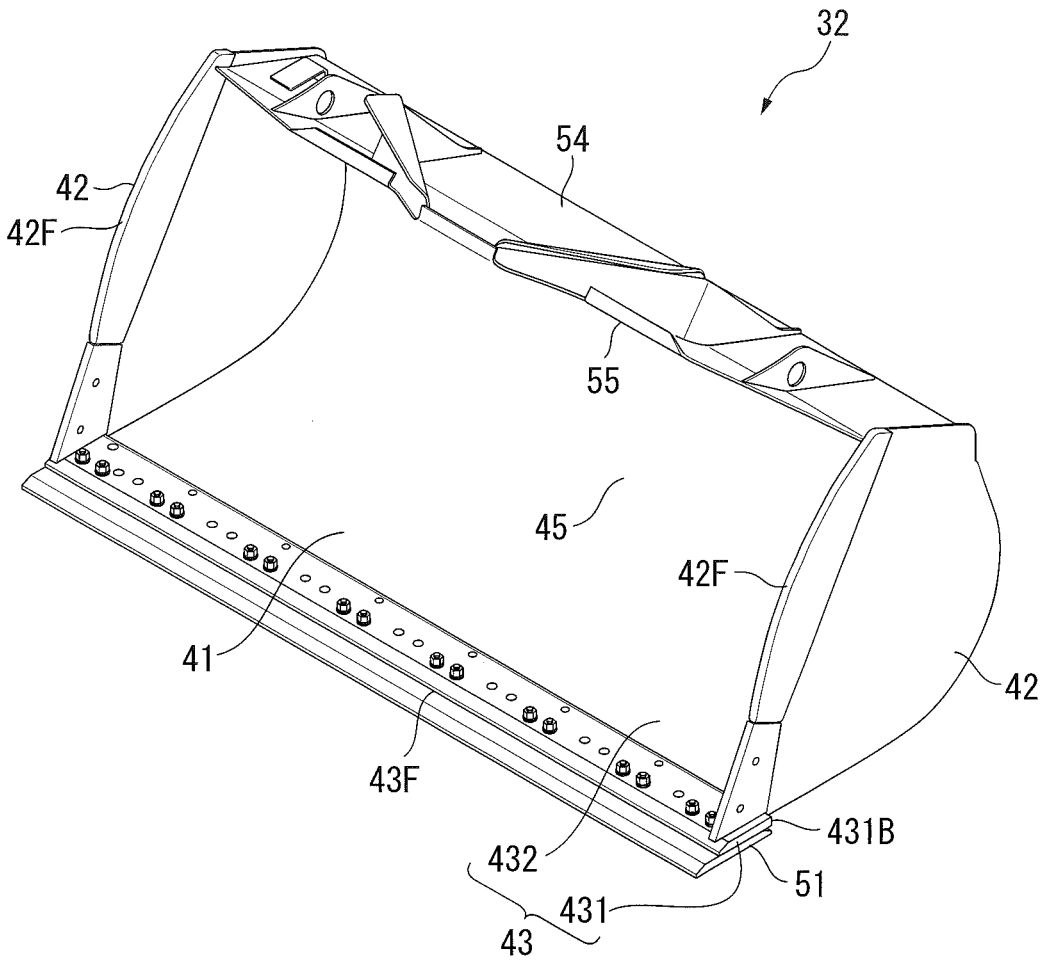
FIG. 2 is a perspective view showing the entirety of a bucket provided to the working vehicle.

FIG. 2 is a perspective view showing the entirety of the bucket 32. FIG. 3 is a sectional view showing a side of the bucket 32 with a bottom 43G being set horizontal.

As shown in FIGS. 2 and 3, the bucket 32, a lower front edge 43F of which is in the form of a linear flat blade, includes a main plate 41 continuous from a lower side to an upper side of the bucket opening, and a pair of side plates 42 covering right and left sides of the main plate 41 and each defining a curved front edge 42F. A lower portion of each of the side plates 42 may be attached with a side edge guard (not shown).

The main plate 41 includes: a first straight portion 43 horizontally extending from the lower front edge 43F toward the innermost of the bucket; a curve 45 defining a lower edge 45L continuous with a rear edge 43B of the first straight portion 43, the curve 45 having a predetermined bucket radius R; a second straight portion 46 continuous with an upper edge 45U of the curve 45 and inclined upward toward the bucket opening; and a third straight portion 48 bent at a bent portion 47 toward the bucket opening relative to a front edge 46F of the second straight portion 46 and further extending toward the bucket opening.

The first straight portion 43 includes a plate-shaped attachment portion 431 including the lower front edge 43F and a plate-shaped bottom 432 continuous with a rear edge 431B of the plate-shaped attachment portion 431, and defines the bottom 43G. The plate-shaped attachment portion 431, which is a thick steel plate elongated along the right-left direction, has a lower surface to which a bottom guard 51 is bolted. The plate-shaped bottom 432, the curve 45, the second straight portion 46, the bent portion 47 and the third straight portion 48 are made of a single steel plate, and a laminated plate 52 is additionally layered over a range from the plate-shaped bottom 432 to a part of the curve 45 to reinforce them.

The bucket radius R of the curve 45 is large as compared with a typical bucket radius. The first straight portion 43 provided before the curve 45 is continuous with the curve 45 having the bucket radius R in a tangent direction.

A stop 53 is provided to a back surface of the second straight portion 46. The stop 53 is a member that is to be deliberately brought into contact with the boom 31 when the wheel loader 1 is in a traveling position (described later). Consequently, the bucket 32, the boom 31, the bell crank 33, and a connecting portion of any other link can be restrained from being rattled during traveling, thereby achieving a noiseless stable traveling.

The bent portion 47, which is defined in an upper exterior surface of the bucket 32, is provided near the innermost of the bucket relative to a reinforcing member 54 for reinforcing a back surface of the third straight portion 48 (i.e., behind the reinforcing member 54). The upper exterior surface of the bucket 32 can thus be reinforced over a wide range not only by the bent portion 47 but also by the reinforcing member 54. The bent portion 47 may be appropriately shaped in the practice of the invention. For instance, the bent portion 47 may be bent with a predetermined bend radius or may be sharply bent to create a right-to-left bend line.

The back surface (exterior surface) of the third straight portion 48 is provided with the reinforcing member 54. A spill guard 55 continuously extends from a front edge 54F of the reinforcing member 54 to cover the bucket opening from above It should be noted that the spill guard 55 is not a component of the main plate 41 of the bucket 32 in the exemplary embodiment.

In the exemplary embodiment, the second straight portion 46, the bent portion 47 and the third straight portion 48 in combination define a bulging portion 56 continuous in the right-left direction and bulging outward from the bucket 32. A hollow space defined by the bulging portion 56 accounts for a part of a bucket capacity.

Description of Traveling Position

Figure 4:
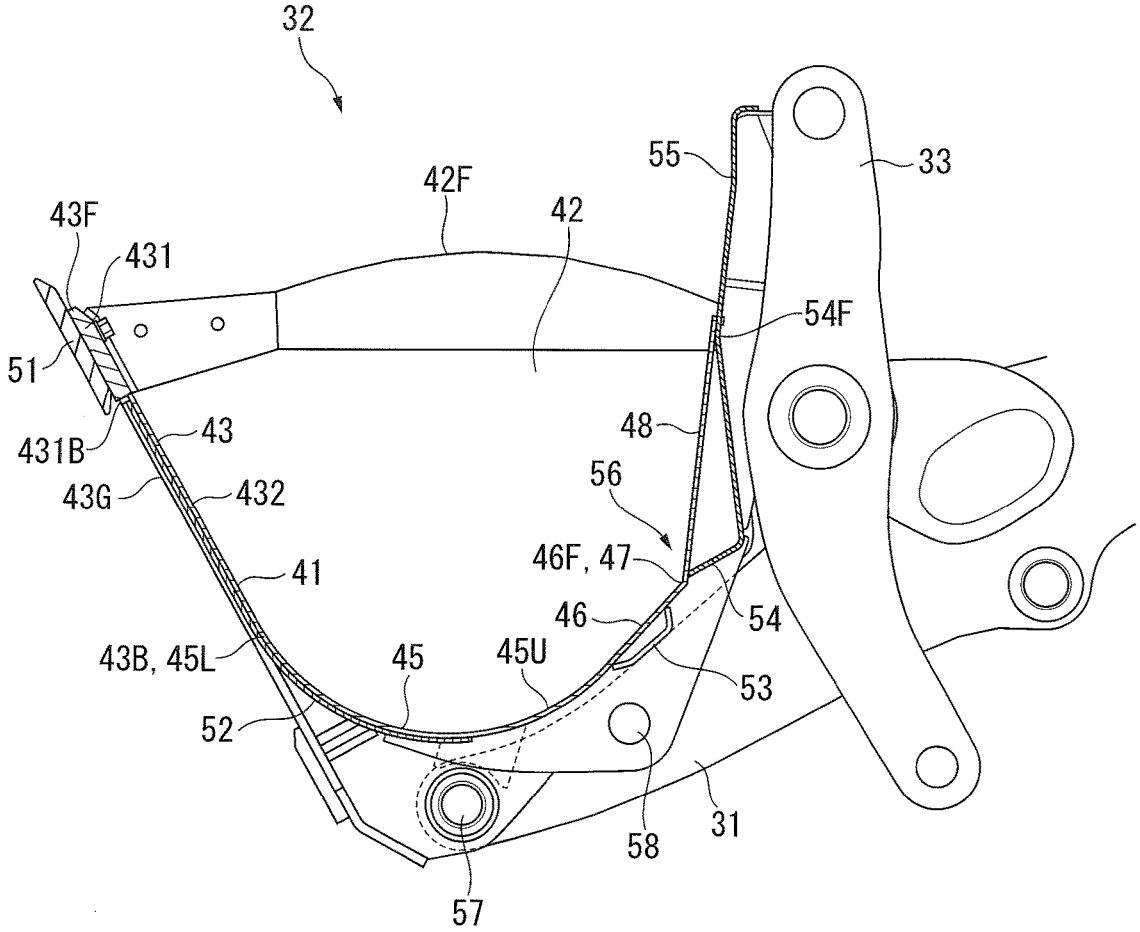
FIG. 4 is a cross sectional view showing a positional relationship between the bucket and a boom in a traveling position.

FIG. 4 shows a positional relationship between the bucket 32 and the boom 31 in the traveling position.

As shown in FIG. 4, in the traveling position, the bucket 32 is tilted at a maximum with the bucket opening facing upward, and the curved front edges 42F of the side plates 42, which connect the front edge of the first straight portion 43 and the front edge of the third straight portion 48 at lateral sides of these front edges, protrude substantially upright. If the bucket included side plates each having a linear front edge, the front edges would be substantially leveled (not shown). In the traveling position, a connecting portion 57 where the bucket 32 is pivotally supported at the end of the boom 31 is lifted above a level of the vehicle body 2 above the ground.

The position of the stop 53, which is bought into contact with the boom 31 in the traveling position, is appropriately determined in view of a moment of the boom 31 that supports the bucket 32 via the stop 53. In the exemplary embodiment, the bucket radius R is maximized as long as the stop 53 is situated at the appropriate position.

The bucket 32 is brought closest to the bell crank 33 at a position corresponding to the third straight portion 48. Accordingly, the shape and dimension of the reinforcing member 54 are appropriately determined so that the reinforcing member 54 can fit in such a narrow space.

It should be noted that, in the figures, a reference numeral 57 seen behind the curve 45 of the bucket 32 denotes the connecting portion between the bucket 32 and the boom 31 as described above, and a reference numeral 58 denotes a connecting portion of a tilt link member (not shown) that connects the lower side of the bell crank 33 and the bucket 32.

Advantage(s) of Exemplary Embodiment(s)

In the exemplary embodiment, the curve 45 of the bucket 32 has a bucket radius larger than a typical one. Consequently, as the bucket 32 is thrust forward for a shoveling work or an excavation work, the object W, which has been pushed into the bucket 32 to reach the curve 45 through the first straight portion 43, can further slide to rise along the curve 45 at the innermost of the bucket as shown by a two-dot chain line and a two-dot chain line arrow C in FIG. 3. The object W can thus be pushed into the bucket 32 more and more without being blocked.

Further, while the large bucket radius R is not expected to increase the bucket capacity so much, the bulging portion 56 defined by the second and third straight portions 46, 48 and the bent portion 47, i.e., the upper portion of the bucket 32, increases the bucket capacity. Additionally, the large bucket radius R can accelerate, in combination with the bulging portion 56, the movement of the object W into the bucket through the upper portion of the bucket opening as shown by a two-dot chain line arrow D.

An advantage of the large bucket radius R lies not only in simply increasing the bucket capacity in combination with the bulging portion 56, but also in facilitating the object W to be pushed toward the innermost of the bucket, thereby effectively utilizing the increased bucket capacity and reliably increasing the workload.

The bucket 32 of the exemplary embodiment includes the curve 45, a front side of which is directly continuous with the first straight portion, so that the bucket 32 is suitable for the object W that should be smoothly slid down only by slightly inclining the bucket 32. Specifically, the object W may be crushed fine rocks and sand with a diameter of, for instance, 40 mm or less.

Further, the bucket 32 can be smoothly thrust into the object W with a small diameter. When the bucket 32 is thrust into the object W with the first straight portion 43 being leveled, an unintended vertical force is restrained from acting on the bucket 32 to efficiently use a tractive force.

Incidentally, it should be understood that the scope of the invention is not limited to the above-described exemplary embodiment(s) but includes any modifications and improvements compatible with the invention.

For instance, in the exemplary embodiment, the first straight portion 43 includes the plate-shaped attachment portion 431 having the lower front edge 43F and the plate-shaped bottom 432 subsequent thereto, but may consist solely of a plate-shaped attachment portion made of a single thick steel plate, the plate-shaped attachment portion including a portion corresponding to the plate-shaped bottom 432.

The invention is applicable to not only a wheel loader, but also a backhoe loader, a skid steer loader and the like.

The invention claimed is:

1. A working equipment for a wheel loader, the working equipment comprising:

a bucket;

a boom having a first end pivotally coupled to a vehicle body frame of the wheel loader and a second end pivotally coupled to the bucket; and a bell crank pivotally coupled to the boom at a middle of the boom, the bucket including:

a blade-shaped lower front edge, a first straight portion horizontally extending from the lower front edge toward an innermost of the bucket, a curve continuous with a rear edge of the first straight portion at a lower edge of the curve, the curve having a predetermined bucket radius, a second straight portion continuous with an upper edge of the curve, the second straight portion being inclined upward toward a bucket opening, a third straight portion bent at a bent portion toward the bucket opening relative to a front edge of the second straight portion, the third straight portion further extending toward the bucket opening, a reinforcing member provided on an exterior surface of the third straight portion and configured to reinforce of the exterior surface, a connecting portion provided behind the curve and connected with the boom, and a stopper provided near the bent portion so as to be in contact with the boom, wherein the reinforcing member is configured, based on the bucket being brought to a position along its range of motion that is closest to the bell crank, to be housed in a space defined by the third straight portion, the boom, and the bell crank.

2. The working equipment according to claim 1, wherein the first straight portion comprises a plate-shaped attachment portion defining the lower front edge and a plate-shaped bottom continuous with a rear edge of the plate-shaped attachment portion.

3. The working equipment according to claim 1, wherein the bent portion is positioned closer to the innermost of the bucket than it is to the reinforcing member.

4. A wheel loader comprising the working equipment according to claim 1.

5. The working equipment according to claim 1, wherein the second straight portion is located at a position opposite to the boom to thereby minimize a distance between the bucket and the boom at the bent portion when the bucket is brought to the position along its range of motion that is closest to the bell crank, and the stopper is provided on a backside of the second straight portion at a position opposite to the boom when the bucket is brought to the position along its range of motion that is closest to the bell crank.

* * * * *